US009632483B2

(12) United States Patent
Boulenguiez et al.

(10) Patent No.: US 9,632,483 B2
(45) Date of Patent: Apr. 25, 2017

(54) SHOCK ABSORBER BODY FOR A BALANCE OF A HOROLOGICAL OSCILLATOR

(71) Applicant: ROLEX SA, Geneva (CH)

(72) Inventors: Benoit Boulenguiez, Viuz-En-Sallaz (FR); Jean-Louis Bertrand, Feigeres (FR); Frederic Burger, Petit-Lancy (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 14/224,906

(22) Filed: Mar. 25, 2014

(65) Prior Publication Data

US 2014/0328150 A1 Nov. 6, 2014

(30) Foreign Application Priority Data

May 1, 2013 (EP) ..... 13166102

(51) Int. Cl.
*G04B 31/02* (2006.01)
*G04B 17/26* (2006.01)
*G04B 17/06* (2006.01)

(52) U.S. Cl.
CPC ..... *G04B 17/26* (2013.01); *G04B 17/06* (2013.01); *G04B 31/02* (2013.01); *Y10T 29/49581* (2015.01)

(58) Field of Classification Search
CPC ..... G04B 17/26; G04B 3/002; G04B 31/02; G04B 17/06; Y10T 29/49581
USPC ..... 368/287, 326
See application file for complete search history.

(56) References Cited

U.S. PATENT DOCUMENTS 1,236,175 A * 8/1917 Hopewell ..... G04B 43/002 368/326
1,544,932 A * 7/1925 Peterson ..... 368/287
1,976,181 A * 10/1934 Marti ..... G04B 31/04 368/326
2,015,905 A * 10/1935 Marti ..... G04B 31/04 368/326
2,194,896 A 3/1940 Gromann
2,282,122 A * 5/1942 Erismann ..... G04B 31/04 368/326
2,538,142 A * 1/1951 Zurcher ..... G04B 31/04 368/326

(Continued)

FOREIGN PATENT DOCUMENTS

CH 257460 4/1949
CH 316832 12/1956

(Continued)

OTHER PUBLICATIONS

European Search Report (ESR) dated Sep. 9, 2014, issued in corresponding European Patent Application No. 14161245, and Written Opinion; with English partial translation and partial machine translation (11 pages).

*Primary Examiner* — Sean Kayes
(74) *Attorney, Agent, or Firm* — Westerman, Hattori, Daniels & Adrian, LLP

(57) ABSTRACT

A shock-absorber body (11) for an assembled balance (6) of a horological oscillator (8), comprising a guiding portion (11*a*) for the shock-absorber body (1) for its mounting on a bridge (2) and a fastening element (13) for an outer end of a spiral spring (5) of the oscillator.

28 Claims, 7 Drawing Sheets

(56) References Cited

U.S. PATENT DOCUMENTS

| | | | | |
|---|---|---|---|---|
| 3,237,394 | A * | 3/1966 | Scholz | F16C 27/02 368/326 |
| 3,487,632 | A | 1/1970 | Scholz | |
| 7,234,859 | B2 * | 6/2007 | Kohler | G04B 31/04 368/326 |
| 8,672,535 | B2 | 3/2014 | Boulenguiez et al. | |
| 2012/0082010 | A1 | 4/2012 | Boulenguiez et al. | |
| 2012/0113767 | A1 * | 5/2012 | Marechal et al. | 368/287 |
| 2013/0155819 | A1 * | 6/2013 | Charbon et al. | 368/126 |
| 2014/0133281 | A1 * | 5/2014 | Stranczl et al. | 368/127 |

FOREIGN PATENT DOCUMENTS

| | | | |
|---|---|---|---|
| CH | 474098 | A | 2/1969 |
| DE | 1933589 | * | 2/1966 |
| DE | 1933589 | U | 2/1966 |
| EP | 1 798 609 | A2 | 6/2007 |
| EP | 2 437 126 | A1 | 4/2012 |
| FR | 1596951 | | 7/1970 |

* cited by examiner

SHOCK ABSORBER BODY FOR A BALANCE OF A HOROLOGICAL OSCILLATOR

The invention relates to a shock-absorber body for an assembled balance of a horological oscillator or to a shock-absorber body of an assembled balance of a horological oscillator. It also relates to a shock-absorber comprising such a shock-absorber body. It also relates to an assembly comprising such a shock-absorber body and a bridge, notably a balance bridge. The invention also relates to a timepiece movement or a timepiece, notably a watch, comprising such a movement or such a shock-absorber or such a shock-absorber body. The invention also relates to a method for producing or assembling an assembly comprising such a shock-absorber body and a bridge, notably a balance bridge. The invention finally relates to a method for putting a timepiece movement into beat comprising such a shock-absorber body and a bridge, notably a balance bridge.

Traditionally, a spiral balance oscillator is mounted in a timepiece movement through the intermediary of a set of parts prearranged on the balance bridge, which parts are designed to allow the movement of the oscillator in rotation and thus allow easy adjusting of the escapement so that, at the deadpoint or balance position, the center of the balance impulse pin is on the line linking the pivotings of the pallet and of the balance.

For this, the outer end of the spiral spring is usually fastened to the balance bridge by a fastening device, for example a balance spring stud holder, which can be displaced in rotation relative to the balance axis. Generally, this device is guided radially about the bearing which is provided to pivot the oscillator, so that the displacement of the outer end of the spiral spring is not perfectly concentric to the balance axis onto which the inner end of the spiral spring is fastened. Thus, an adjusting operation, or an impact, risks inducing a radial displacement of the outer end of the spiral spring relative to its inner end. This situation results in a degradation of the timekeeping of the timepiece movement, particularly at the isochronism level.

There are three ways of displacing a device for fastening the outer end of a spiral spring relative to the balance axis.

A first particularly economical solution is disclosed in patent CH316832. This consists in implementing a balance bridge with a deformable arm acting as balance spring stud holder. The outer end of the spiral can thus be displaced by a certain angle by folding the deformable area of the bridge when the objective is small adjustments. This design has the major drawback of being able to displace the balance spring stud freely in space. Thus, an adjusting operation risks distorting both the parallel alignment of the spiral spring relative to the plane of the movement, and also the distance between the balance spring stud and the balance axis in the plane of the movement, which induces significant timekeeping defects, particularly in isochronism.

One solution for partially remedying the abovementioned defects is explained in the fascicule CH257460. The balance spring stud holder takes the form of a slotted ring with an elasticity enabling it to be adjusted and held in a determined angular position around a conical portion of a balance end piece which is screwed onto the balance bridge. This implementation presents two defects. It is very difficult to guarantee a perfect centering between the balance axis and the balance end piece. Also, the balance spring stud holder is deformed on assembly, and it is therefore difficult to control the locating of the balance spring stud in the plane of the movement relative to the center of the balance end piece. It is therefore not possible to allow a perfectly concentric displacement of the balance spring stud relative to the balance axis.

One solution making it possible to improve the centering of a balance spring stud holder consists in pivoting it on a shock-absorber which allow both the radial guidance and the axial travel of the balance axis. This implementation, disclosed for example by the document FR1596951, makes it possible to lessen the chain of dimensions between the balance axis and the balance spring stud holder. It does not however make it possible to mitigate the risks of displacement of the balance spring stud in the plane of the movement because of the deformation of the elastic balance spring stud holder.

Other similar designs do exist. For example, the document EP1798609 discloses a device for a fine setting of the adjusting through the intermediary of additional means. This device also implements an elastic balance spring stud holder designed to turn about a shock-absorber of a balance axis. This design makes it possible to finely adjust the rotation of the balance spring stud holder relative to the shock-absorber, but does not make it possible to correct its radial travel. This solution therefore does not provide a response to the technical problem.

In light of the prior art, there is no simple solution for proposing a device for reliably assembling the outer end of the spiral on the balance bridge and which prevents any radial displacement of the outer end of the spring relative to its inner end while allowing its angular displacement.

The aim of the invention is to provide a shock-absorber body of an assembled balance of a horological oscillator making it possible to remedy the drawbacks mentioned previously and enhance the shock-absorber bodies known from the prior art. In particular, the invention proposes a simple and reliable shock-absorber body that makes it possible to perform an adjusting without adversely affecting the timekeeping performance.

A shock-absorber body according to the invention can be defined as a shock-absorber body for an assembled balance of a horological oscillator, comprising a guiding portion for the shock-absorber body for its mounting on a bridge and a fastening element for an outer end of a spiral spring of the oscillator.

Different embodiments of a shock-absorber body according to the invention can be defined as follows:

- The shock-absorber body as above, wherein it comprises a first shock-absorber body part including a portion for receiving the fastening element for an outer end of a spiral spring of the oscillator, the fastening element forming a second body part mounted, notably driven, onto the first shock-absorber body part.
- The shock-absorber body as above, wherein the fastening element for an outer end of a spiral spring of the oscillator is made of a piece with the shock-absorber body or in that the shock-absorber body is produced as a plurality of assembled parts.
- The shock-absorber body as above, wherein the fastening element for an outer end of a spiral spring of the oscillator is a balance spring stud holder.
- The shock-absorber body as above, wherein the fastening element for an end of a spiral spring of the oscillator has a bearing surface at least partially complementing and substantially parallel to a bearing surface of the spiral and of the fastening means which make it possible to retain these surfaces.
- The shock-absorber body as above, wherein it comprises a rotational driving zone about its longitudinal axis, the zone comprising a conformation, for example a knurling or a notching or a polygonal conformation or teeth or flats, to allow the shock-absorber body to be driven in rotation, notably using a tool.

The shock-absorber body as above, wherein it comprises a friction element opposing the free rotation of the shock-absorber body relative to the bridge.

The shock-absorber body as above, wherein the friction element comprises at least one shoulder intended to bear on the bridge and/or in that the friction element comprises an elastic return element, notably an elastic washer, in particular a Belleville-type washer.

In one embodiment, notably an embodiment that can be combined with one or more of the previous embodiments, the shock-absorber body can be defined as comprising a tightening element, notably one or more screws, designed to press a surface of a bridge against a surface of a fastening element so as to immobilize the fastening element relative to the bridge, notably by friction.

A shock-absorber according to the invention can be defined as a shock-absorber of an assembled balance of a horological oscillator comprising a shock-absorber body as above, a pivoting jewel, a counter-pivot jewel, and a spring for holding these jewels in the body.

An assembly according to the invention can be defined as comprising a shock-absorber body as above and a bridge, in particular an assembly in which conformations of the shock-absorber body, such as shoulders, and conformations of the bridge, such as shoulders, cooperate obstacle-fashion to retain the shock-absorber body in one direction or in two directions in the direction of the axis of the shock-absorber body, relative to the bridge, and optionally, comprising an elastic element such as an elastic washer, notably a Belleville washer, interposed between the bridge and the shock-absorber body.

A timepiece movement according to the invention can be defined as comprising a shock-absorber body as above or a shock-absorber as above or an assembly as above.

A timepiece according to the invention, notably a watch, can be defined as comprising a movement as above or an assembly as above or a shock-absorber as above or a shock-absorber body as above.

An adjusting method according to the invention can be defined as a method for putting a timepiece movement into beat as above, wherein it comprises an action of positioning a body of a shock-absorber if an assembled balance of a horological oscillator by rotation of the body about its longitudinal axis.

A method for producing an assembly according to the invention, notably a timepiece movement or a timepiece, comprising a shock-absorber body of an assembled balance (6) of a horological oscillator and a bridge, can be defined as comprising the following steps:

supplying a first shock-absorber body part, notably a first part of a shock-absorber body as above;

supplying the bridge;

introducing the first shock-absorber body part into a bore of the bridge;

mounting, notably by driving, a second shock-absorber body part, notably a second shock-absorber body part including a fastening element for fastening an outer end of a spiral spring of an oscillator, on the first shock-absorber body part; and optionally, implementing the adjusting method as above.

A timepiece movement according to the invention or an assembly according to the invention can be obtained by the implementation of the method as above.

The attached drawings represent, by way of examples, embodiments of a timepiece according to the invention including embodiments of timepiece movements according to the invention.

Figure 1:
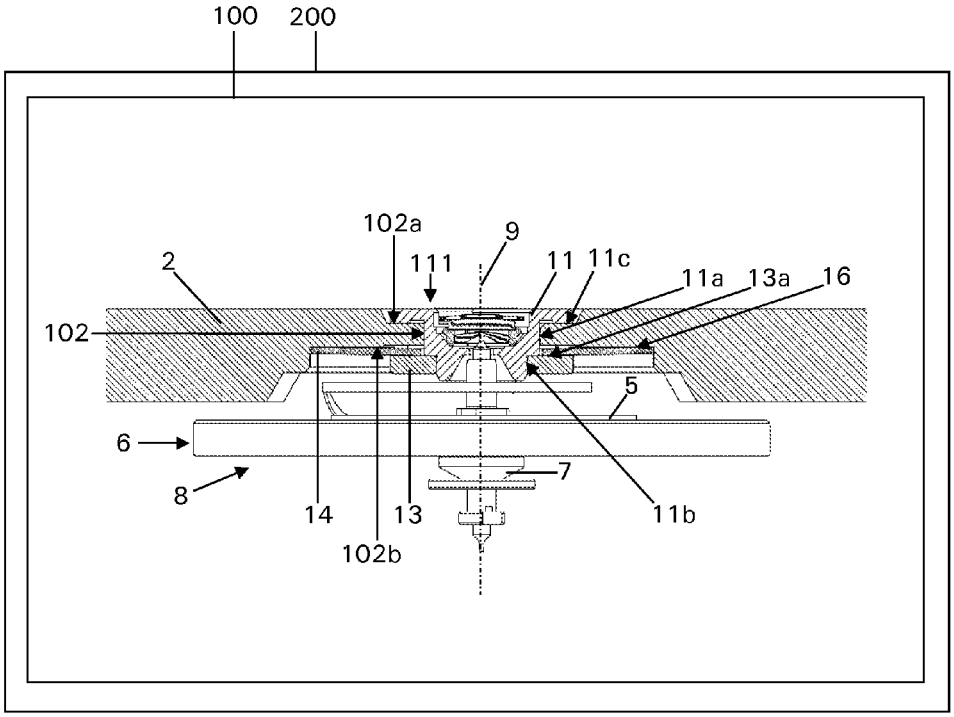
FIG. 1 is a partial cross-sectional view of a first embodiment of a timepiece movement according to the invention.
Figure 2:
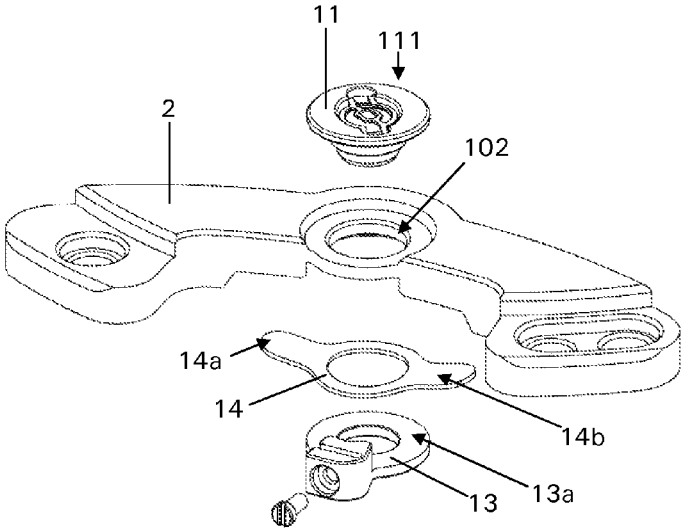
FIG. 2 is an exploded perspective view of the first embodiment of a timepiece movement according to the invention.
Figure 3:
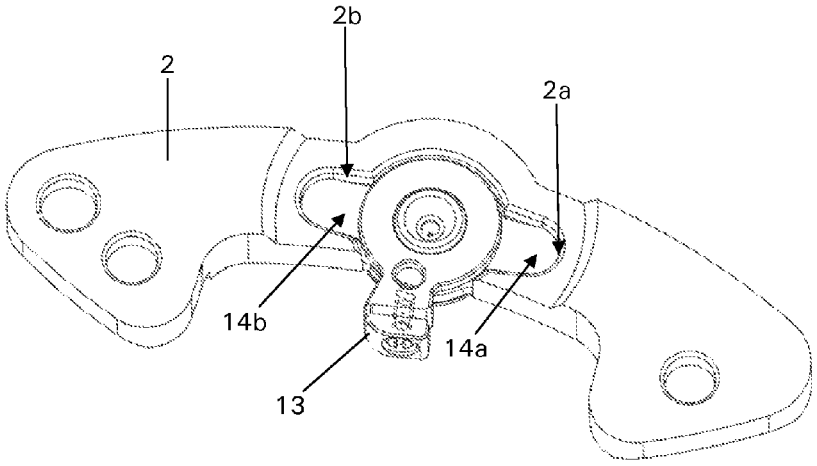
FIG. 3 is a perspective view of the first embodiment of a timepiece movement according to the invention.
Figure 4:
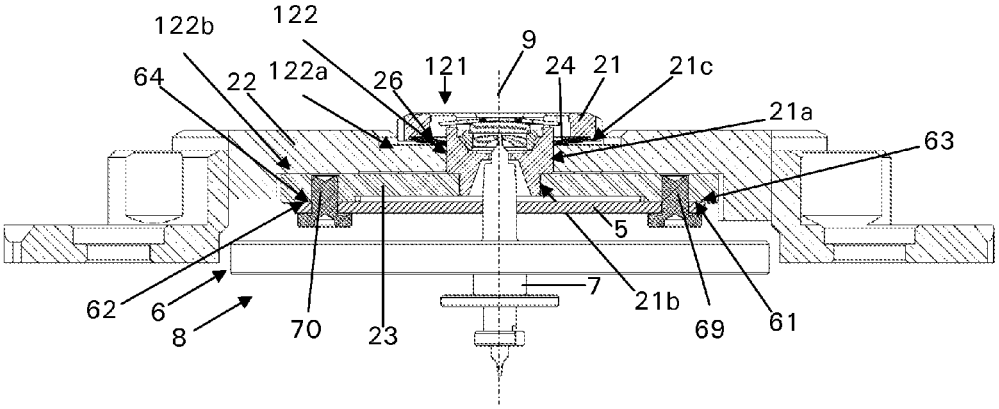
FIG. 4 is a partial cross-sectional view of a second embodiment of a timepiece movement according to the invention.
Figure 5:
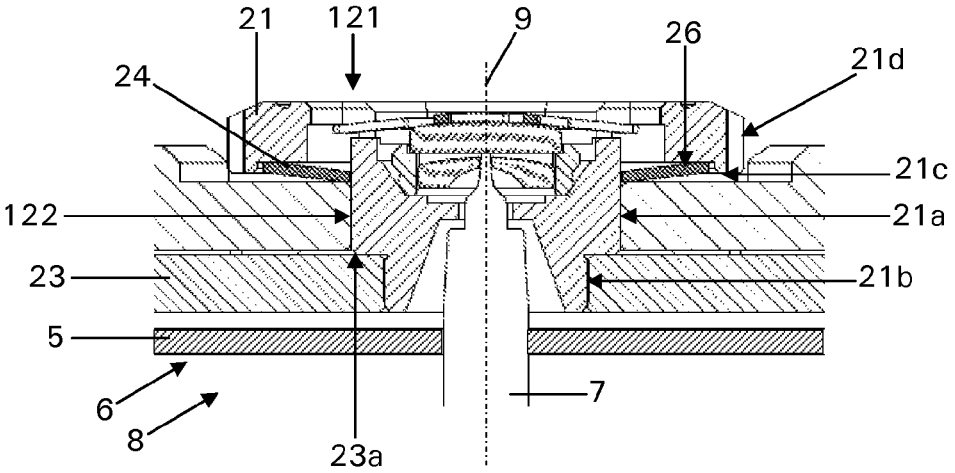
FIG. 5 is a detail partial cross-sectional view of the second embodiment of a timepiece movement according to the invention.
Figure 6:
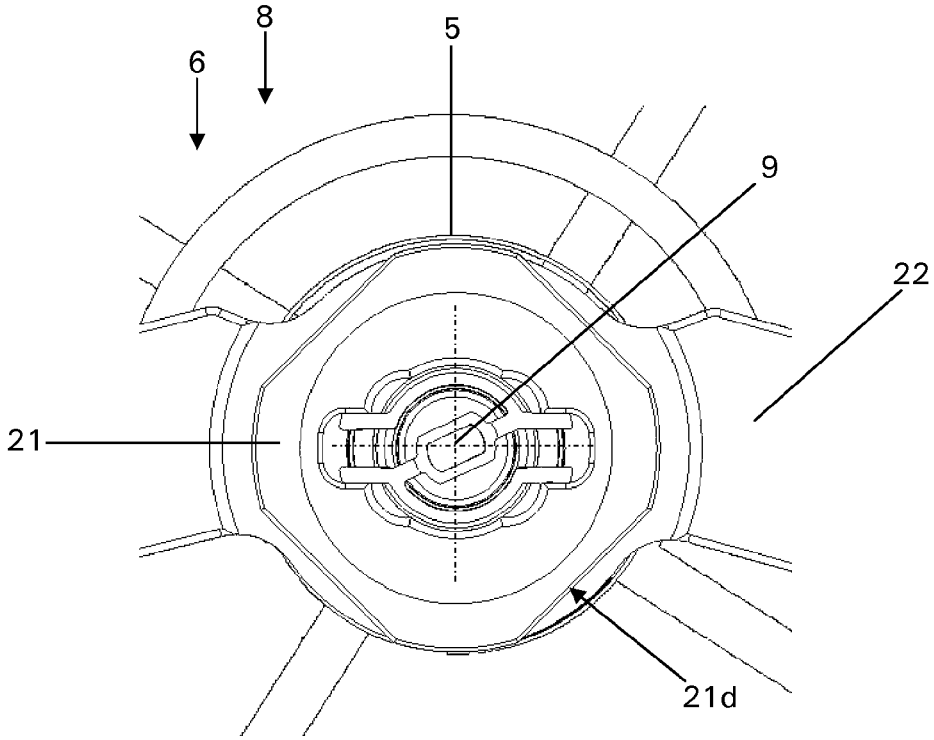
FIG. 6 is a plan view of the second embodiment of a timepiece movement according to the invention.
Figure 7:
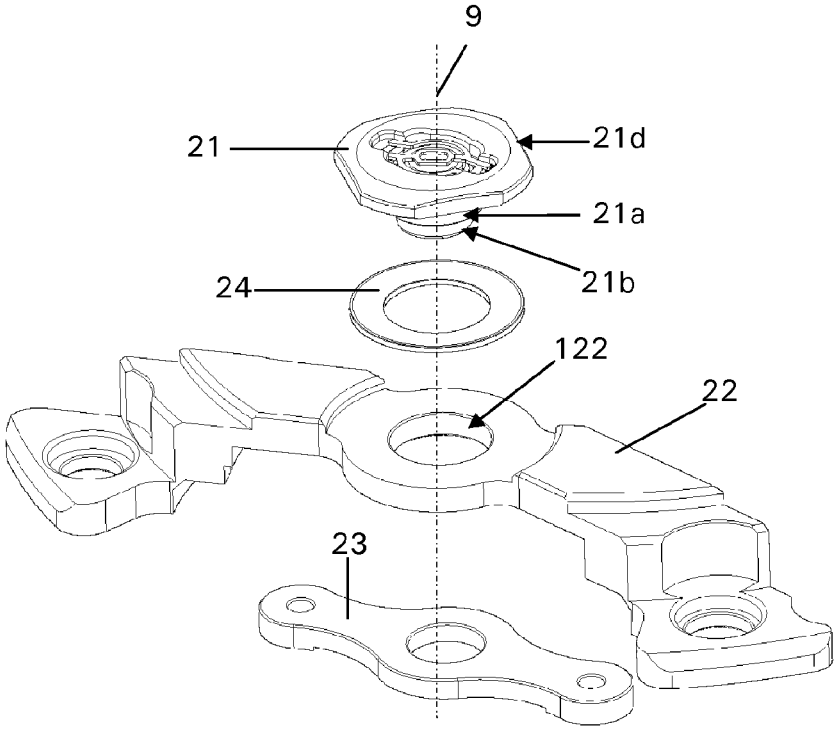
FIG. 7 is an exploded perspective view of the second embodiment of a timepiece movement according to the invention.

A first embodiment of a timepiece 200 is described hereinbelow with reference to FIGS. 1 to 3. The timepiece comprises a first embodiment of a timepiece movement 100. The timepiece movement comprises a balance bridge 2 making it possible to pivot an oscillator 8 in cooperation with a plate (not represented). The oscillator is in particular pivoted via a shock-absorber 111 mounted on the balance bridge. The oscillator notably comprises an assembled balance 6, that is to say a balance mounted on a shaft 7. In FIGS. 1 to 3, the timepiece movement is not fully represented: only the balance bridge 2 and the oscillator 8 are represented.

The balance bridge 2 comprises a bore 102 in which the shock-absorber 111 is mounted. The balance bridge comprises a first shoulder 102*a* at a first end of the bore and a second shoulder 102*b* at a second end of the bore. The bridge also comprises fastening elements allowing it to be mounted on the plate of the timepiece movement (not represented in FIGS. 1 to 3).

The shock-absorber 111 comprises a shock-absorber body for the assembled balance 6 of the horological oscillator 8. The shock-absorber body comprises a guiding portion 11*a* for the shock-absorber body 11 for its mounting on the bridge 2, in particular in the bore 102. Advantageously, the shock-absorber body is mounted by sliding into the bore 102. The shock-absorber body comprises a shoulder 11*c* cooperating for example with the first shoulder 102*a* to axially stop the shock-absorber body, directly or via an elastic element such as an elastic washer.

The shock-absorber body 11 comprises an element 13 for fastening an outer end of a spiral spring 5 of the oscillator. Advantageously, the fastening element also comprises a shoulder 13*a* cooperating with the second shoulder 102*b* to axially stop the shock-absorber body, directly or via an elastic element such as an elastic washer 14. The element 13 for fastening the outer end of the spiral spring of the oscillator is mounted, advantageously driven, onto a portion 11*b* for receiving the shock-absorber body. The portion 11*b* is, for example, cylindrical of revolution. Even more advantageously, the fastening element 13 is driven onto the portion 11*b* that comes into contact with a shoulder situated at the end of the portion 11*b* of the shock-absorber body 11.

In this first embodiment, the shock-absorber body 11 is monobloc or made of one and the same part. However, alternatively, the shock-absorber body 11 can be made up of a plurality of parts. The shock-absorber 111 comprises, for example, in addition to the shock-absorber body, mounted therein, a pivoting jewel, a counter-pivot jewel and a spring for holding said jewels in the body.

Figure 13:
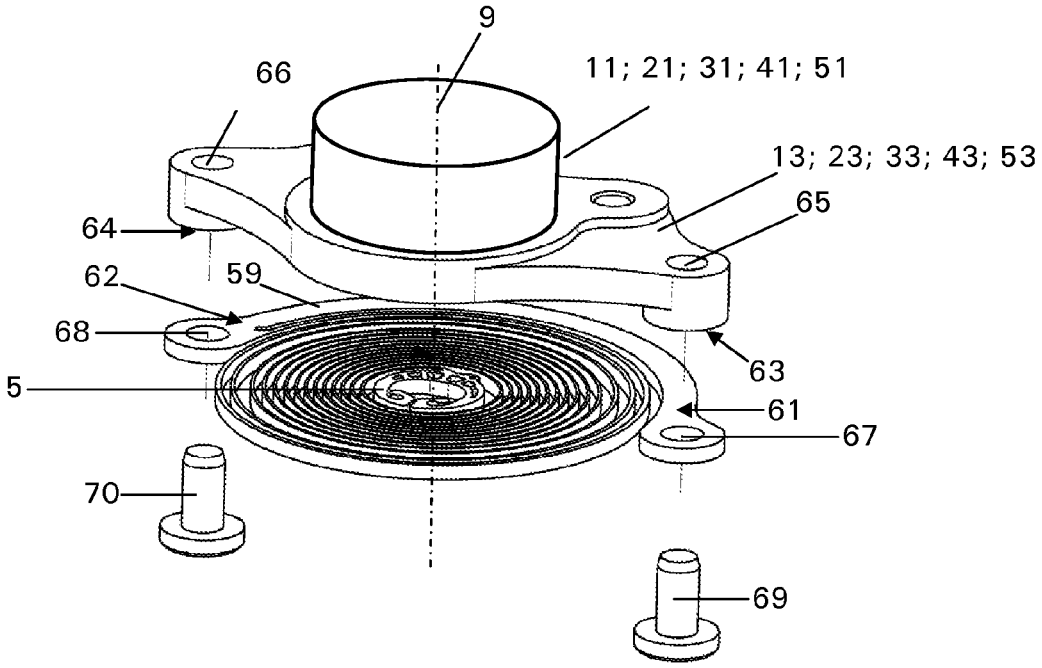
FIG. 13 is an exploded view of a method for fastening a spiral spring on a fastening element for the outer end of the spiral spring.

In this first embodiment, the element for fastening the outer end of the spring is a balance spring stud holder. However, alternatively, the element for fastening the outer end of the spring can be of another type, notably a fastening element such as disclosed in the document EP2437126A1. Thus, as represented in FIG. 13, the fastening element can be designed to fasten one or more outer ends of a spiral spring of an oscillator. Such a fastening element has a bearing surface 63, 64 at least partially complementing and substantially parallel to a bearing surface 61, 62 of the spiral spring 5, notably a bearing surface of a link member 59 made of a single piece with the spiral spring, and fastening means 65, 66, 69, 70, 67, 68 which make it possible to retain these surfaces or immobilize these surfaces against one another or relative to one another. Such a fastening means is particularly suited to a spiral spring made of a brittle material, such as silicon, diamond or quartz. For example, the fastening means comprise holes 65, 66 on the fastening element and pins 69, 70 intended to be mounted in the holes. The fastening means make it possible to keep the bearing surfaces pressed against one another. The pins can pass through the holes 67, 68 provided in the link member. Such a fastening mode is described here as applied to the first embodiment, but it can be applied to the different embodiments of the subject of the present invention.

The shock-absorber body advantageously comprises a friction element 16 opposing the free rotation of the shock-absorber body relative to the bridge. The friction element comprises, for example, the elements 11*c*, 13*a*, 102*a* and 102*b*. More particularly, the shoulders or shoulders 11*c*, 13*a* are intended to be on either side of the bridge, notably to abut against the shoulders 102*a* and 102*b* of the bridge. Advantageously, the friction element can comprise an elastic return element 14. In this first embodiment, the elastic return element 14 is a small elastic plate provided with at least one protrusion 14*a*, 14*b* which is designed to be housed in the matching form 2*a*, 2*b* produced on the balance bridge 2 and thus to prevent any angular displacement of the elastic element relative to the balance bridge in order to control the axial force that it produces and therefore the friction torque. Because of this, the friction torque is completely determined by the friction effect that occurs at the interface of the shoulders 11*c* and 102*a*. It follows that, when a torque is exerted that tends to drive the shock-absorber body rotationally in a certain direction relative to the bridge, a friction torque opposing this displacement is applied by the bridge to the shock-absorber body.

Thus, to avoid the abovementioned defects, the element for fastening the outer end of the spiral is securely attached, at least in rotation, to the bearing of the oscillator, consisting of a shock-absorber which is mounted on the balance bridge. For this, the element for fastening the outer end of the spiral is securely attached to the shock-absorber of the balance axis. Thus, in an adjusting operation or in the event of an impact, the radial displacement of the outer end of the spiral relative to the balance axis is zero and the timekeeping performance levels of the movement are future proofed. In this first embodiment, a balance spring stud holder is, for example, implemented, which is designed to fasten the outer end of the spiral in a conventional manner by pinning up to the stud. In this case, the adjustment is performed conventionally by acting directly on the balance spring stud holder. Alternatively, the shock-absorber body can be provided with means for allowing the rotation of the shock-absorber-balance spring stud holder assembly.

A second embodiment of the timepiece movement is described hereinbelow with reference to FIGS. 4 to 7.

The timepiece movement comprises a balance bridge 22 making it possible to pivot an oscillator 8 in cooperation with a plate (not represented).

The balance bridge 22 comprises a bore 122 in which the shock-absorber 121 is mounted. The balance bridge comprises a first shoulder 122*a* at a first end of the bore and a second shoulder 122*b* at a second end of the bore. The bridge also comprises fastening elements allowing it to be mounted on a plate of the timepiece movement (not represented).

The shock-absorber 121 comprises a shock-absorber body of the assembled balance 6 of the horological oscillator 8. The shock-absorber body comprises a guiding portion 21*a* for the shock-absorber body 21 for its mounting on the bridge 22, in particular in the bore 122. Advantageously, the shock-absorber body is mounted by sliding into the bore 122. The shock-absorber body comprises a shoulder 21*c* cooperating with the first shoulder 122*a* of the bridge 22 to axially stop the shock-absorber body, directly or via an elastic element 24 such as an elastic washer. Thus, the elastic element 24 is interposed or arranged between the bridge and the shock-absorber body.

The shock-absorber body 21 comprises an element 23 for fastening an outer end of a spiral spring 5 of the oscillator. The fastening element also comprises a shoulder 23*a* cooperating with the second shoulder 122*b* of the bridge 22 to axially stop the shock-absorber body, directly or via an elastic element such as an elastic washer. The fastening element 23 is mounted, advantageously driven, onto a portion 21*b* for receiving the shock-absorber body intended to receive the element 23 for fastening the outer end of the spiral spring of the oscillator. The portion 21*b* is, for example, cylindrical of revolution. Even more advantageously, the fastening element 23 is driven onto the portion 21*b* until it comes into contact with a shoulder situated at the end of the portion 21*b*.

In this second embodiment, the shock-absorber body is monobloc or made from one and the same part. The shock-absorber comprises, for example, in addition to the shock-absorber body, mounted therein, a pivoting jewel, a counter-pivot jewel and a spring for holding said jewels in the body.

In this second embodiment, the element for fastening the outer end of the spiral spring has a bearing surface at least partially complementing and substantially parallel to a bearing surface of the spiral spring, notably a bearing surface of a link member made of a single piece with the spiral spring, and fastening means which make it possible to retain these surfaces.

The shock-absorber body advantageously comprises a friction element 26 opposing the free rotation of the shock-absorber body relative to the bridge. The friction element comprises, for example, the elements 21*c*, 23*a*, 122*a* and 122*b*. More particularly, the shoulders or shoulders 21*c*, 23*a* are intended to be on either side of the bridge, notably to abut against the shoulders 122*a* and 122*b* of the bridge. The friction element can comprise an elastic return element 24, notably an elastic washer. In this embodiment, this elastic washer takes the form of a Belleville washer with a stiffness that makes it possible to generate a suitable axial force to make it possible to hold the assembly comprising the shock-absorber and the element for fastening the outer end of the spiral spring of the oscillator in a given angular position, and to do so independently of any additional means. It has been found that this design choice is particularly robust with regard to the force produced by the spring and the manufacturing and assembly tolerances of the components. In practice, the action of the elastic element provokes pressurized contact between shoulders, notably the shoulders 21*c* and 122*a*. It follows that, when a torque tending to drive the shock-absorber body rotationally in a certain direction relative to the bridge is exerted, a friction torque opposing this displacement is applied by the bridge to the shock-absorber body.

Advantageously, the shock-absorber body comprises a rotational driving zone 21*d* about its longitudinal axis 9 which also constitutes the axis of the balance. The driving zone can comprise a specific conformation, such as a knurling or a notching or teeth or flats or a polygonal conformation or a conformation of any suitable geometry, to allow the shock-absorber body to be driven in rotation, notably using a tool. Such a rotational displacement of the shock-absorber body makes it possible to rotationally displace the element 13 for fastening the outer end of the spiral spring of the oscillator and therefore perform an easy adjustment.

Figure 8:
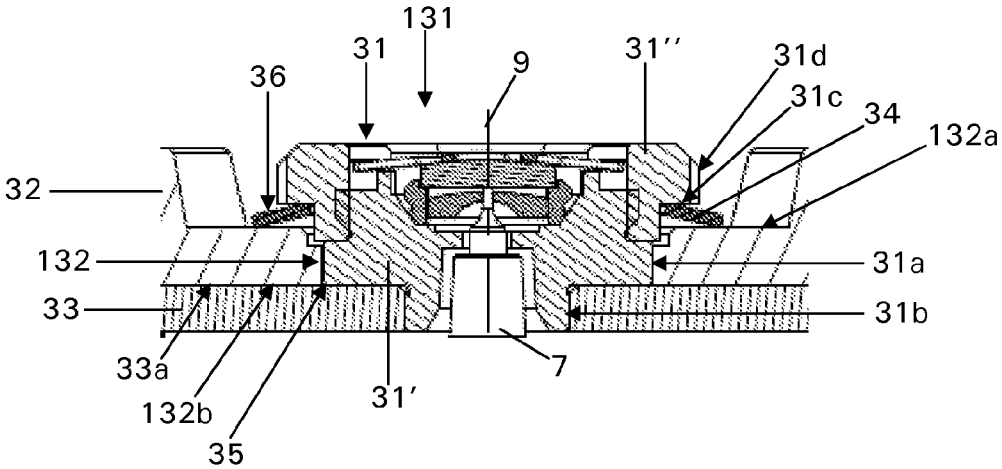
FIG. 8 is a detail partial cross-sectional view of a third embodiment of a timepiece movement according to the invention.
Figure 9:
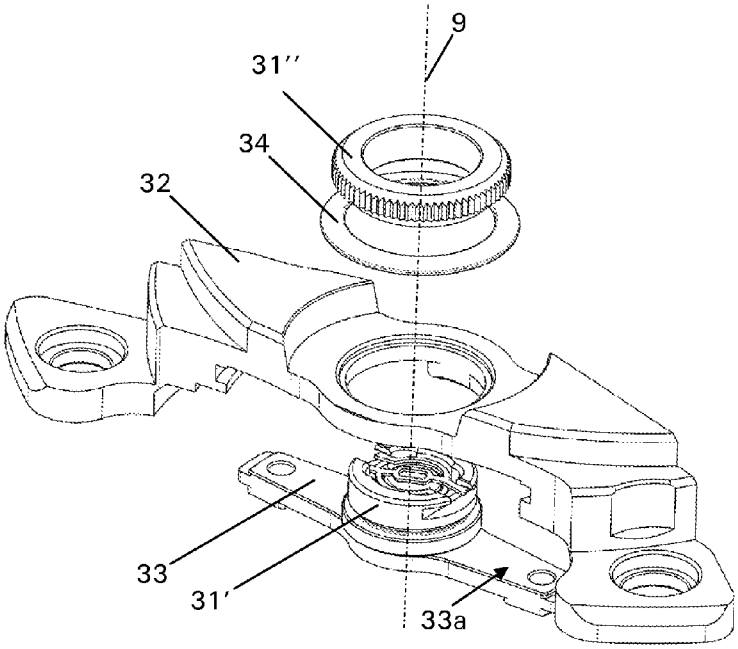
FIG. 9 is an exploded perspective view of the third embodiment of a timepiece movement according to the invention.

A third embodiment of a timepiece movement is described hereinbelow with reference to FIGS. 8 and 9.

The timepiece movement comprises a balance bridge 32 making it possible to pivot an oscillator 8 in cooperation with a plate (not represented).

The balance bridge 32 comprises a bore 132 in which the shock-absorber 131 is mounted. The balance bridge comprises a first shoulder 132*a* at a first end of the bore and a second shoulder 132*b* at a second end of the bore. The bridge also comprises fastening elements enabling it to be mounted on a plate of the timepiece movement (not represented).

The shock-absorber 131 comprises a shock-absorber body 31 for the assembled balance 6 of the horological oscillator 8. The shock-absorber body comprises a guiding portion 31*a* for the shock-absorber body 31 for its mounting on the bridge 32, in particular in the bore 132. Advantageously, the shock-absorber body is mounted by sliding into the bore 132. The shock-absorber body comprises a shoulder 31*c* cooperating with the first shoulder 132*a* of the bridge 32 to axially stop the shock-absorber body, directly or via an elastic element 34 such as an elastic washer. Thus, the elastic element 34 is interposed or arranged between the bridge and the shock-absorber body.

The shock-absorber body 31 comprises an element 33 for fastening an outer end of a spiral spring 5 of the oscillator. The fastening element also comprises a shoulder 33*a* cooperating with the second shoulder 132*b* of the bridge 32 to axially stop the shock-absorber body, directly or via an elastic element such as an elastic washer. The fastening element 33 is mounted, advantageously driven, onto a portion 31*b* for receiving the shock-absorber body intended to receive the element 33 for fastening the outer end of the spiral spring of the oscillator. The portion 31*b* is, for example, cylindrical of revolution. Even more advantageously, the fastening element 33 is driven onto the portion 31*b* until it comes into contact with a shoulder situated at the end of the portion 31*b*.

In this third embodiment, the shock-absorber body is produced in two parts: a stock 31' and a head 31". For example, the head 31" is fastened or assembled on the stock 31', for example by screwing. Thus, it becomes possible to securely attach the pivoting bearing of the balance axis to the spiral fastening element 33, before final assembly of the balance bridge. The stock 31' and the head 31" will, for example, be able to be assembled or securely attached during the assembly of the balance bridge.

The shock-absorber body advantageously comprises a friction element 36 opposing the free rotation of the shock-absorber body relative to the bridge. The friction element comprises, for example, the elements 31*c*, 33*a*, 132*a*, 132*b*. More particularly, the shoulders or shoulders 31*c*, 33*a* are intended to be on either side of the bridge, notably to abut against the shoulders 132*a* and 132*b* of the bridge. The friction element can comprise an elastic return element 34, notably an elastic washer, in particular a washer of Belleville type.

Advantageously, the shock-absorber body comprises a rotational driving zone 31*d* about its longitudinal axis 9. Thus, the adjustment is performed easily by acting directly on the shock-absorber body.

In this third embodiment, the shock-absorber comprises, for example, in addition to the shock-absorber body, mounted therein, a pivoting jewel, a counter-pivot jewel and a spring for holding said jewels in the body.

In this third embodiment, the element for fastening the outer end of the spiral spring has a bearing surface at least partially complementing and substantially parallel to a bearing surface of this spiral spring, notably a bearing surface of a link member made of a single piece with the spiral spring, and fastening means which make it possible to retain these surfaces.

Figure 10:
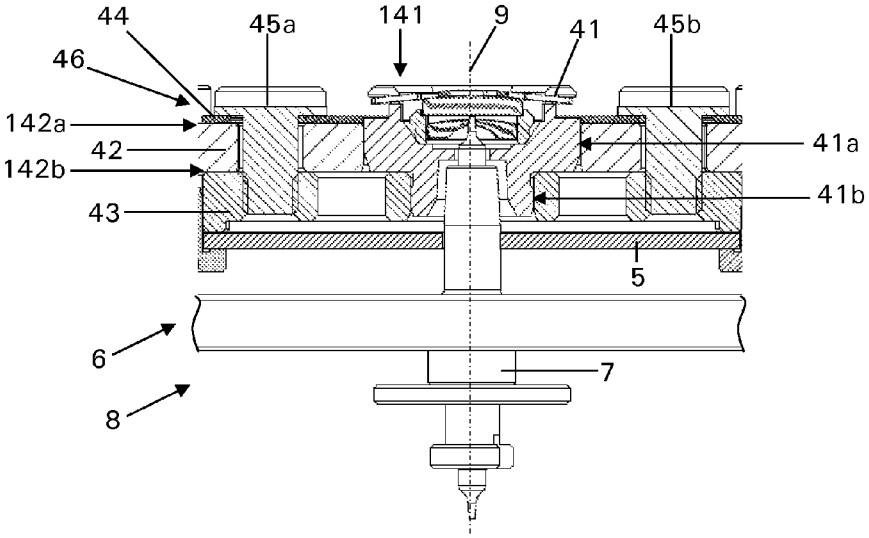
FIG. 10 is a detail partial cross-sectional view of a fourth embodiment of a timepiece movement according to the invention.
Figure 11:
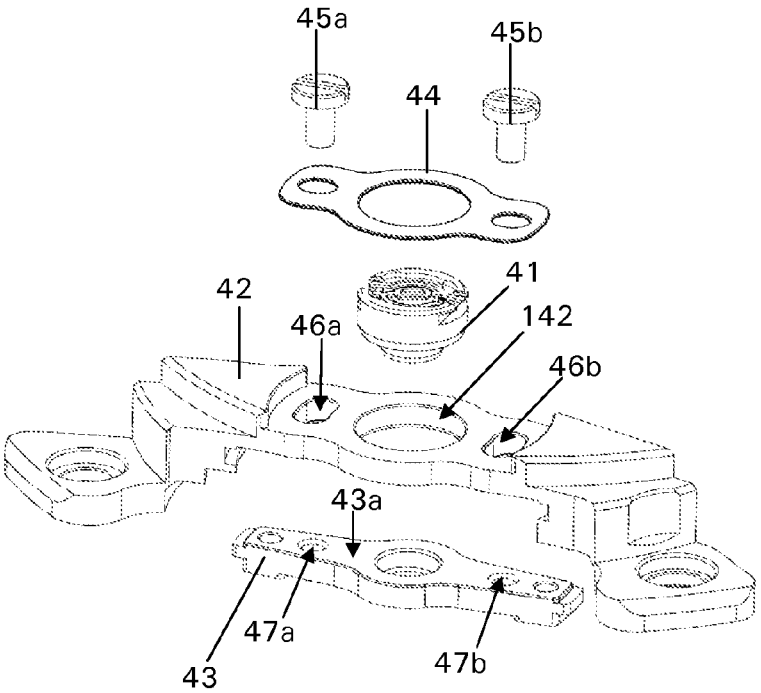
FIG. 11 is an exploded perspective view of the fourth embodiment of a timepiece movement according to the invention.

A fourth embodiment of a timepiece movement is described hereinbelow with reference to FIGS. 10 and 11.

The timepiece movement comprises a balance bridge 42 making it possible to pivot an oscillator 8 in cooperation with a plate (not represented).

The balance bridge 42 comprises a bore 142 in which the shock-absorber 141 is mounted. The balance bridge comprises a first shoulder 142*a* at a first end of the bore and a second shoulder 142*b* at a second of the bore. The bridge also comprises fastening elements allowing it to be mounted on a plate of the timepiece movement (not represented).

The shock-absorber 141 comprises a shock-absorber body for the assembled balance 6 of the horological oscillator 8. The shock-absorber body comprises a guiding portion 41*a* for the shock-absorber body 41 for its mounting on the bridge 42, in particular in the bore 142. Advantageously, the shock-absorber body is mounted by sliding into the bore 142.

The shock-absorber body 41 comprises an element 43 for fastening an outer end of a spiral spring 5 of the oscillator. The fastening element also comprises a shoulder 43*a* cooperating with the second shoulder 142*b* to axially stop the shock-absorber body, directly or via an elastic element such as an elastic washer. The fastening element 43 is mounted, advantageously driven, onto a portion 41*b* for receiving the shock-absorber body, which portion is intended to receive the element 43 for fastening the outer end of the spiral spring of the oscillator. The portion 41*b* is, for example, cylindrical of revolution. Even more advantageously, the fastening element 43 is driven onto the portion 41*b* until it comes into contact with a shoulder situated at the end of the portion 41*b*.

In this fourth embodiment, the shock-absorber body is monobloc or made of one and the same part. The shock-absorber comprises, for example, in addition to the shock-absorber body, mounted therein, a pivoting jewel, a counter-pivot jewel and a spring for holding said jewels in the body.

In this fourth embodiment, the element for fastening the outer end of the spiral spring has a bearing surface at least partially complementing and substantially parallel to a bearing surface of the spiral spring, notably a bearing surface of a link member made of a single piece with the spiral spring, and fastening means which make it possible to retain these surfaces.

The shock-absorber body advantageously comprises a friction element 46 opposing the free rotation of the shock-absorber body relative to the bridge. The friction element can comprise an elastic return element 44. Thus, the elastic element 34 is interposed or arranged between the bridge and the shock-absorber body, with 45*a* and 45*b* considered to form part of the element 43 for fastening the outer end of the spiral.

In this fourth embodiment, additional elements such as screws 45*a*, 45*b* are provided in order to reinforce the hold of the element 43 for fastening the outer end of the spiral. More particularly, these screws can be screwed into tapped holes 47*a*, 47*b* of the fastening element 43 and can pass through oblong cutouts 46*a*, 46*b* formed on the balance bridge 42. In this case, a slight loosening of these screws makes it possible to allow the rotation of the shock-absorber body and of the fastening element about the axis 9, to perform an adjusting operation. However, the rotation is not completely free, a friction torque opposing the rotation of the shock-absorber body is defined by the action of the friction element notably producing pressures between the shoulder 43*a* and the second shoulder 142*b* of the bridge 42. Alternatively, the friction element 46, notably the elastic return element 44, can be removed from the shock-absorber body 41. In this configuration, the angular position of the shock-absorber body and that of the fastening element are established by at least one screw 45*a*, 45*b*. In this case, a slight loosening of these screws makes it possible to allow the rotation of the shock-absorber body and of the fastening element about the axis 9 with a minimal resisting torque.

In this fourth embodiment, the adjustment is performed by acting directly on the element for fastening the outer end of the spiral.

Figure 12:
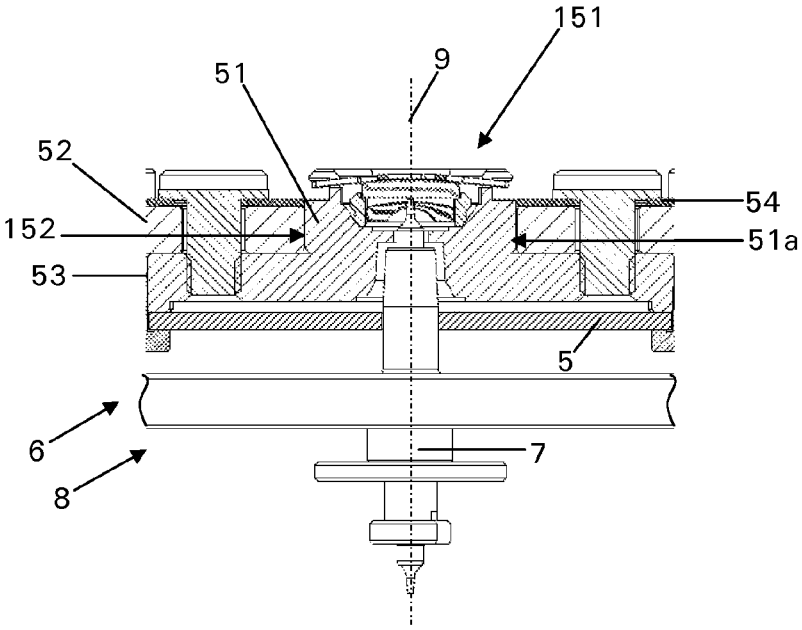
FIG. 12 is a detail partial cross-sectional view of a fifth embodiment of a timepiece movement according to the invention.

A fifth embodiment of a timepiece movement is described hereinbelow with reference to FIG. 12. This fifth embodiment differs from the preceding embodiment only in that the shock-absorber body is manufactured of a single piece with the element for fastening the outer end of the spiral.

In these fourth and fifth embodiments, the shock-absorber body or the shock-absorber comprises a tightening element, notably one or more screws, intended to press a surface of the bridge against a surface of the fastening element so as to immobilize the fastening element relative to the bridge, notably by friction.

The invention also relates to an assembly, a movement or a timepiece comprising a shock-absorber body, notably a shock-absorber body such as described in one of the preceding embodiments, and a bridge. In particular, the invention relates to an assembly in which conformations of the shock-absorber body, such as shoulders, and conformations of the bridge, such as shoulders, cooperate obstacle-fashion to retain the shock-absorber body in one direction or in two directions in the direction of the axis of the shock-absorber body, relative to the bridge.

One method for executing a method for putting a timepiece movement into beat is described hereinbelow.

Such a method comprises an action for positioning the shock-absorber body by rotation about its longitudinal axis 9. Advantageously, this action is exerted by a watchmaker, possibly using a tool on the body of a shock-absorber such as described in the second and third embodiments, in particular on a driving zone 21*d*, 31*d* of the shock-absorber body. Alternatively, this action can be exerted on the element for fastening the outer end of the spiral spring of the oscillator such as described in the first, fourth and fifth embodiments.

Moreover, an implementation of a method for producing an assembly comprising a shock-absorber body of an assembled balance of a horological oscillator and a bridge is described hereinbelow. This method comprises the following steps:

a. supplying a first shock-absorber body part, notably a first shock-absorber body part such as described in one of the preceding embodiments;
b. supplying a bridge;
c. introducing the first shock-absorber body part into a bore of the bridge;
d. mounting, notably by driving, a second shock-absorber body part, notably a second shock-absorber body part including a fastening element for fastening an outer end of a spiral spring of an oscillator, on the first shock-absorber body part.

The preceding steps can be performed by the following chronology: a., b., c. and d., but not necessarily.

In particular, the step b. can be implemented after the step a. Alternatively, the step a. can be implemented after the step b.

The step d. can be implemented after the step c. Alternatively, the step c. can be implemented after the step d. In this case, by introducing the shock-absorber body into the bore of the bridge, a part of the shock-absorber body-fastening element subassembly is introduced into the bore of the bridge. This subassembly can also be designated shock-absorber body.

Optionally, the production method can comprise a step of implementing the adjusting method described previously.

Obviously, any timepiece movement or assembly obtained by the implementation of the production method or of the adjusting method described previously constitutes an object of the present invention.

In each of the embodiments, a radial gap between the shock-absorber body and the balance bridge is advantageously provided so as to allow a rotation of the shock-absorber and of the element for fastening the outer end of the spiral relative to the balance bridge. A washer or small elastic plate can also be provided to cooperate with these elements in order to generate a suitable friction torque and thus allow easy adjustment of the adjusting of the oscillator, and, optionally, advantageously make it possible to hold the device for fastening the outer end of the spiral in a given angular position.

In each of the embodiments, a shock-absorber is mounted on a balance bridge. Alternatively, the shock-absorber can be mounted on a plate or any other bridge configured to pivot an assembled balance.

In each of the embodiments, the shock-absorber comprises, in addition to the shock-absorber body, and mounted therein, a pivoting jewel, a counter-pivot jewel and a spring for holding said jewels in the body. Obviously, the shock-absorber, in addition to the shock-absorber body, can comprise a single jewel serving as pivoting jewel and/or counter-pivot jewel and possibly a spring for securing this jewel in the body. Alternatively, the shock-absorber can comprise a monobloc shock-absorber body provided with longitudinal pivoting and clearance means for the assembled balance. In this last configuration, the shock-absorber can thus be limited to the shock-absorber body. This shock-absorber body can be monobloc or consist of a plurality of parts.

As seen previously, the shock-absorber body according to the invention can be:

retained axially, notably by shoulders, in both directions so as to future proof its location with respect to the balance bridge, and/or retained axially, notably by shoulders, in at least one direction by the element for fastening the outer end of the spiral.

As seen previously, the element for fastening the outer end of the spiral can be arranged under the balance bridge to axially retain the shock-absorber body in a first direction.

As seen previously, in the first, second and third embodiments, a shoulder of the shock-absorber body can be provided to axially retain the shock-absorber body in a second direction.

As seen above, in the fourth and fifth embodiments, screws can axially fasten the components, that is to say axially fasten the fastening element on the balance bridge.

As seen above, a friction spring can be arranged coaxially to the shock-absorber body. The spring is designed to hold the shock-absorber body with respect to the bridge. Such a spring can be likened to a washer provided to hold an index assembly by friction with respect to a balance spring stud holder.

As seen above, a friction spring preferentially has a center of symmetry consisting of the pivoting axis of the shock-absorber body.

As seen above, a friction spring preferentially takes the form of an elastic washer, notably of a Belleville washer.

As seen previously, the shock-absorber body can be produced in a single part, that is to say produced as a monobloc part notably comprising the housing for receiving components of the shock-absorber, such as the jewels, and the element for fastening the outer end of the spiral spring of the oscillator.

Alternatively, as seen previously, the shock-absorber body can be produced in a plurality of parts, for example a first part comprising the housing for receiving components of the shock-absorber and a second part comprising the element for fastening the outer end of the spiral spring of the oscillator. In this case, the first part and the second part are mounted on one another, for example driven one onto the other. The first and second parts are thus immobilized relative to one another. Whatever the case, the first and second parts are at least immobilized in rotation relative to one another in relation to the axis of rotation of the assembled balance.

Thus, even when an adjustment of the oscillator, such as an adjusting, is required, it is not possible to displace the first shock-absorber body part rotationally about the axis of the balance without equally displacing the second shock-absorber body about the axis of the balance. Consequently, to perform such an adjustment, all of the shock-absorber is displaced in rotation.

In this document, "device for fastening the outer end of a spiral spring" should be understood to mean a device for fastening at least an outer end of at least one blade of a spiral spring.

In this document, "assembled balance" should be understood to mean an assembly comprising or consisting of a balance axis, a balance, a roller and a collet, the balance, the roller and the collet being mounted on the balance axis. Thus, "assembled balance" should be understood to mean a balance mounted on its axis or its shaft. This assembled balance can be designed to cooperate with any type of timepiece escapement, notably a Swiss lever escapement or a detent escapement, or even a Robin escapement. The assembled balance is not part of the shock-absorber body or of the shock-absorber.

The invention claimed is:

1. A shock-absorber body configured for an assembled balance of a horological oscillator, comprising:

(i) a guiding portion for mounting the shock-absorber body on a bridge, wherein the guiding portion comprises a rotational driving zone about a longitudinal axis of the shock-absorber body, the zone comprising a conformation to allow the shock-absorber body to be driven in rotation, wherein the rotational driving zone includes a peripheral outwardly-oriented cylindrical surface symmetrical around a longitudinal axis, (ii) at least one shoulder extending outwardly relative to the peripheral cylindrical surface, and (iii) a fastening element for fastening an outer end of a spiral spring of the oscillator to the shock-absorber body, wherein the fastening element is integrally mounted with the guiding portion, so that the fastening element is positioned by positioning the guiding portion of the shock-absorber body, wherein the guiding portion is configured to be positioned by rotating the shock-absorber body relative to a balance bridge.

2. The shock-absorber body as claimed in claim 1, which comprises a first shock-absorber body part including a portion configured for receiving a second shock-absorber body part including the fastening element for an outer end of a spiral spring of the oscillator, the second shock-absorber body part being mounted onto the first shock-absorber body part.

3. The shock-absorber body as claimed in claim 1, wherein the conformation allows the shock-absorber body to be driven in rotation using a tool.

4. The shock-absorber body as claimed in claim 1, wherein the fastening element for an outer end of a spiral spring of the oscillator is made of one piece with the guiding portion of the shock-absorber body.

5. The shock-absorber body as claimed in claim 1, wherein the fastening element for an outer end of a spiral spring of the oscillator is a balance spring stud holder.

6. The shock-absorber body as claimed in claim 1, wherein the fastening element for an end of a spiral spring of the oscillator has a first bearing surface at least partially complementing and substantially parallel to a second bearing surface of the spiral and a third bearing of the fastening element which make it possible to retain the first, second and third bearing surfaces.

7. The shock-absorber body as claimed in claim 1, which comprises a friction element opposing the free rotation of the shock-absorber body relative to the bridge.

8. The shock-absorber body as claimed in claim 7, wherein at least one of (i) the friction element comprises at least one shoulder intended to bear on the bridge and (ii) the friction element comprises an elastic return element.

9. A shock-absorber configured for an assembled balance of a horological oscillator, wherein the shock-absorber comprises a shock-absorber body as claimed in claim 1, a pivoting jewel, a counter-pivot jewel, and a spring for holding these jewels in the body.

10. An assembly comprising a shock-absorber body as claimed in claim 1 and a bridge, wherein conformations of the shock-absorber body and conformations of the bridge cooperate obstacle-fashion to retain the shock-absorber body relative to the bridge in one direction or in two directions along the longitudinal axis of the shock-absorber body.

11. The assembly as claimed in claim 10, which comprises an elastic element interposed between the bridge and the shock-absorber body.

12. Timepiece movement comprising a shock-absorber body as claimed in claim 1.

13. A timepiece comprising a movement as claimed in claim 12.

14. A method for putting a timepiece movement comprising (i) a horological oscillator comprising an assembled balance, and (ii) the shock-absorber body as claimed in claim 1 into beats, wherein the method comprises positioning the shock-absorber body in the timepiece movement by rotation of the shock-absorber body about a longitudinal axis of the shock-absorber body.

15. A method for producing an assembly, comprising (i) shock-absorber body configured for an assembled balance of a horological oscillator, and (ii) a bridge, the method comprising the following steps:

supplying a first shock-absorber body part;

supplying the bridge;

introducing the first shock-absorber body part into a bore of the bridge; and mounting a second shock-absorber body part, on the first shock-absorber body part, so that the assembly comprises the shock-absorber body according to claim 1.

16. The method of claim 15, comprising providing the assembly in a timepiece movement, and adjusting the timepiece movement so as to put the timepiece movement into beats, said adjusting comprising positioning the shock-absorber body of the assembly by rotation of the shock-absorber body about a longitudinal axis of the shock-absorber body.

17. Timepiece movement comprising (i) a horological oscillator comprising an assembled balance, and (ii) the shock-absorber body according to claim 1, wherein the timepiece movement has been obtained by implementation of a method for putting the timepiece movement into beats, wherein the method comprises positioning the shock-absorber body in the timepiece movement by rotation of the shock-absorber body about a longitudinal axis of the shock-absorber body.

18. Timepiece movement comprising an assembly comprising (i) a shock-absorber body configured for an assembled balance of a horological oscillator, and (ii) a bridge, wherein the assembly has been obtained by implementation of a method for producing an assembly comprising:

supplying a first shock-absorber body part;

supplying the bridge;

introducing the first shock-absorber body part into a bore of the bridge; and mounting a second shock-absorber body part, on the first shock-absorber body part, so that the assembly comprises the shock-absorber body according to claim 1.

19. The shock-absorber body as claimed in claim 2, wherein the second shock-absorber body part is driven onto the first shock-absorber body part.

20. The shock-absorber body as claimed in claim 1, wherein the conformation is a knurling or a notching or a polygonal conformation or teeth or flats.

21. The shock-absorber body as claimed in claim 1, wherein the shock-absorber body is produced as a plurality of assembled parts.

22. A shock-absorber comprising a shock-absorber body as claimed in claim 1 and a pivoting jewel.

23. An assembly comprising:

a shock-absorber body configured for an assembled balance of a horological oscillator, comprising:

a guiding portion for mounting the shock-absorber body on a bridge, a fastening element for fastening an outer end of a spiral spring of the oscillator to the shock-absorber body, a bridge, and an elastic element interposed between the bridge and the shock-absorber body, wherein the fastening element is integrally mounted with the guiding portion, so that the fastening element is positioned by positioning the guiding portion of the shock-absorber body, and wherein conformations of the shock-absorber body and conformations of the bridge cooperate obstacle-fashion to retain the shock-absorber body in one direction or in two directions in the direction of the axis of the shock-absorber body, relative to the bridge.

24. A method for putting a timepiece movement comprising (i) a horological oscillator comprising an assembled balance, and (ii) the assembly as claimed in claim 23 into beats, wherein the method comprises positioning the shock-absorber body in the timepiece movement by rotation of the shock-absorber body about a longitudinal axis of the shock-absorber body.

25. A method for producing an assembly, comprising (i) shock-absorber body configured for an assembled balance of a horological oscillator, and (ii) a bridge, the method comprising the following steps:

supplying a first shock-absorber body part;

supplying the bridge;

introducing the first shock-absorber body part into a bore of the bridge; and mounting a second shock-absorber body part, so as to obtain the assembly according to claim 23.

26. A shock-absorber body for an assembled balance of a horological oscillator, comprising:

a guiding portion for mounting the shock-absorber body on a bridge, a fastening element for fastening an outer end of a spiral spring of the oscillator to the shock-absorber body, and a rotational driving zone about a longitudinal axis of the shock-absorber body, the zone comprising a conformation to allow the shock-absorber body to be driven in rotation, wherein the conformation is a knurling or a notching or a polygonal conformation or teeth or flats, wherein the fastening element is integrally mounted with the guiding portion, so that the fastening element is positioned by positioning the guiding portion of the shock-absorber body.

27. A method for putting a timepiece movement comprising (i) a horological oscillator comprising an assembled balance, and (ii) the shock-absorber body as claimed in claim 26 into beats, wherein the method comprises positioning the shock-absorber body in the timepiece movement by rotation of the shock-absorber body about a longitudinal axis of the shock-absorber body.

28. A method for producing an assembly, comprising (i) shock-absorber body configured for an assembled balance of a horological oscillator, and (ii) a bridge, the method comprising the following steps:

supplying a first shock-absorber body part;

supplying the bridge;

introducing the first shock-absorber body part into a bore of the bridge; and mounting a second shock-absorber body part on the first shock-absorber body part, so that the assembly comprises the shock-absorber body according to claim 26.

* * * * *